US011298743B2

(12) United States Patent
Zhu et al.

(10) Patent No.: US 11,298,743 B2
(45) Date of Patent: Apr. 12, 2022

(54) CRYSTALLIZER FOR CONTINUOUS CASTING

(71) Applicants: ZHEJIANG HAILIANG CO., LTD., Zhejiang (CN); ZHEJIANG KEYU METAL MATERIAL CO., LTD., Zhejiang (CN); GUANGDONG HAILIANG COPPER INDUSTRY CO., LTD., Guangdong (CN)

(72) Inventors: Zhangquan Zhu, Zhejiang (CN); Xuelong Zhao, Zhejiang (CN); Huanfeng Feng, Zhejiang (CN); Lirong Jiang, Zhejiang (CN); Shaojun Jiang, Zhejiang (CN); Gangfeng Sun, Zhejiang (CN); Yunlong Wang, Zhejiang (CN); Huanjun Zhao, Zhejiang (CN)

(73) Assignees: ZHEJIANG HAILIANG CO., LTD., Zhejiang (CN); ZHEJIANG KEYU METAL MATERIAL CO., LTD., Zhejiang (CN); GUANGDONG HAILIANG COPPER INDUSTRY CO., LTD., Guangdong (CN)

( * ) Notice: Subject to any disclaimer, the term of this patent is extended or adjusted under 35 U.S.C. 154(b) by 0 days.

(21) Appl. No.: 16/765,166

(22) PCT Filed: Jan. 25, 2019

(86) PCT No.: PCT/CN2019/073054
§ 371 (c)(1),
(2) Date: May 19, 2020

(87) PCT Pub. No.: WO2019/149138
PCT Pub. Date: Aug. 8, 2019

(65) Prior Publication Data

US 2020/0368808 A1 Nov. 26, 2020

(30) Foreign Application Priority Data

Jan. 30, 2018 (CN) ..... 201810090356.7

(51) Int. Cl.
*B22D 11/055* (2006.01)

(52) U.S. Cl.
CPC ..... *B22D 11/055* (2013.01)

(58) Field of Classification Search
CPC ... B22D 11/005; B22D 11/045; B22D 11/055; B22D 11/143
See application file for complete search history.

(56) References Cited

U.S. PATENT DOCUMENTS 3,502,135 A 3/1970 Wertli
4,480,679 A * 11/1984 Katschinski ..... B22D 11/0403 164/420

(Continued)

FOREIGN PATENT DOCUMENTS

CN 102248137 11/2011
CN 202263907 6/2012

(Continued)

OTHER PUBLICATIONS

"International Search Report (Form PCT/ISA/210) of PCT/CN2019/073054", dated Apr. 4, 2019, with English translation thereof, pp. 1-6.

*Primary Examiner* — Kevin E Yoon
(74) *Attorney, Agent, or Firm* — JCIP Global Inc.

(57) ABSTRACT

Disclosed is a crystallizer for continuous casting, which relates to the field of horizontally continuous casting of copper/copper alloy bars, comprising: a graphite sleeve provided with a plurality of drawing holes, and a cooling jacket provided therein with a coolant cavity; the graphite sleeve is plate-shaped; the cooling jacket is plate-shaped and provided with at least two; the cooling jacket is attached to (Continued)

two sides of the plate surfaces of the graphite sleeve to cool the graphite sleeve. The present disclosure may simultaneously draw out five and more copper bars, which greatly boots the production efficiency.

6 Claims, 2 Drawing Sheets

(56) References Cited

U.S. PATENT DOCUMENTS

| | | | | | |
|---|---|---|---|---|---|
| 4,640,337 | A * | 2/1987 | Sevastakis | ..... | B22D 11/055<br>164/348 |
| 5,358,028 | A * | 10/1994 | Keutgen | ..... | B22D 11/1284<br>164/420 |

FOREIGN PATENT DOCUMENTS

| | | |
|---|---|---|
| CN | 104325098 | 2/2015 |
| CN | 105798246 | 7/2016 |
| CN | 206065359 | 4/2017 |
| CN | 206286517 | 6/2017 |
| CN | 108237208 | 7/2018 |
| CN | 208033608 | 11/2018 |
| CN | 208033609 | 11/2018 |
| FR | 1476181 | 4/1967 |
| JP | H11277186 | 10/1999 |

* cited by examiner

CRYSTALLIZER FOR CONTINUOUS CASTING

CROSS-REFERENCE TO RELATED APPLICATION

This application is a 371 of international application of PCT application serial no. PCT/CN2019/073054, filed on Jan. 25, 2019, which claims the priority benefit of China application no. 201810090356.7, filed on Jan. 30, 2018. The entirety of each of the above mentioned patent applications is hereby incorporated by reference herein and made a part of this specification.

FIELD

Embodiments of the present disclosure generally relate to the field of horizontally continuous casting of copper/copper alloy bars, and more specifically relate to a crystallizer for continuous casting.

BACKGROUND

Conventionally, continuous casting of copper/copper alloy bars generally adopts a horizontal continuous casting process, and a crystallizer as used is a circular crystallizer. For red copper bars and copper alloy bars with diameters above Φ20 mm, a circular crystallizer can only continuously cast and draw out one strand per time. For copper alloy bars with diameters less than Φ10 mm, a circular crystallizer can only continuously cast and draw out at most 5 strands per time. Therefore, the prior art has a low production efficiency and a low unit output.

SUMMARY

To solve the foregoing problems, the present disclosure provides a crystallizer for continuous casting, which may simultaneously draw out more than five copper bars, thereby greatly boosting production efficiency.

To achieve the object above, the present disclosure adopts a technical solution below:

A crystallizer for continuous casting comprises: a graphite sleeve provided with a plurality of drawing holes, and a cooling jacket provided inside with a coolant cavity; wherein the graphite sleeve is plate-shaped and has two plate surfaces; the drawing holes penetrate through the two plate surfaces along a length direction or a width direction of the graphite sleeve; and the cooling jacket is plate-shaped and provided with at least two, the two plate surfaces being both attached to the cooling jacket to cool the graphite sleeve.

Further, the cooling jacket comprises a first cooling jacket, the first cooling jacket including a cover plate and a base; the base comprises a base plate, a first side plate parallel to a length direction of the drawing holes and a second side plate perpendicular to the length direction of the drawing holes; the cover plate, the base plate, the first side plate, and the second side plate enclose to form the coolant cavity; the cover plate is provided with a first liquid inlet hole; and the first side plate is provided with a first liquid outlet hole.

More further, the base plate is provided with a plurality of bar-shaped convex edges, length directions of the convex edges being parallel to the first side plates, two adjacent convex edges form a flow path for a coolant to pass through; a first gap and a second gap are provided between two end faces of the convex edges and the second side plate, respectively, the first liquid outlet hole being disposed at the first gap.

Still further, the first cooling jacket comprises a liquid guide plate, the liquid guide plate being provided between the convex edges and the cover plate, an inner side face of the cover plate is provided with a liquid guide groove in communication with the first liquid inlet hole; the liquid guide groove and the liquid guide plate guide the coolant above the second gap into the coolant cavity.

Even further, a plurality of liquid guide plates are provided, wherein the plurality of liquid guide plates are arranged abreast along a direction which the drawing holes are arranged; a partition is provided between adjacent liquid guide plates; the partition is disposed at one side of the second gap and connected with the second side plate; a number of the liquid guide grooves and a number of first liquid inlets correspond to a number of liquid guide plates.

Preferably, one graphite sleeve is provided; and two sides of the plate surfaces of the graphite sleeve are both attached with the first cooling jacket.

Preferably, the cooling jacket comprises a second cooling jacket; the crystallizer for continuous casting comprises a graphite sleeve, a first cooling jacket, and a second cooling jacket, wherein two or more graphite sleeves are provided; the second cooling jacket is attached between two adjacent graphite sleeves; two first cooling jackets are provided, the graphite sleeves and the second cooling jacket being provided between the two first cooling jackets.

Preferably, the second cooling jacket is provided with a second liquid inlet hole and a second liquid outlet hole, the second liquid inlet hole and the second liquid outlet hole being disposed at a same side of the length direction of the drawing holes.

Preferably, a plurality of coolant passages is provided inside the coolant cavity of the second cooling jacket.

Preferably, the graphite sleeve has two side faces along the length directions of the drawing holes; the cooling jacket comprises a third cooling jacket, and the two side faces are both attached to the third cooling jacket to cool the side faces of the graphite sleeve.

After adopting the technical solution above, the present disclosure has the following advantages:

1. The graphite sleeve is plate-shaped, and the drawing holes penetrate through the graphite sleeve along a length direction or a width direction of the graphite sleeve. With this arrangement, the width of the graphite sleeve may be set based on the number of copper bars which need to be drawn out. Therefore, if the graphite sleeve is sufficiently wide, more copper bars may be drawn out. Further, by setting the cooling jacket also plate-shaped and attaching the cooling jacket to two sides of the plate surfaces of the graphite sleeve, the cooling effect of the cooling jacket is guaranteed. Meanwhile, when it is needed to increase the output, multiple layers of graphite sleeves may be set to further increase the number of copper bars that may be drawn out.

2. The coolant cavity is enclosed by the cover plate, the base plate, the first side plate and the second side plate. In other words, when the length of the graphite sleeve is greater than that of the cooling jacket, the cooling jacket may be extended by connecting a plurality of cooling jackets. Moreover, different lengths of cooling jackets may be fabricated for connecting with each other to satisfy cooling demands of graphite sleeves of different lengths. As such, the adaptability of the cooling jacket is enhanced. Further, if the graphite sleeve has a relatively large length, use of a cooling jacket of an equal size might cause a phenomenon of ununiform cooling; while the approach of connecting a plurality of cooling jackets may avoid occurrence of such phenomenon and thus guarantees production quality. By arranging liquid inlet holes on the cover plate, the inlet liquid may uniformly enter the coolant cavity. By arranging liquid outlet holes on the first side plate, the coolant that has finished cooling may be autonomously discharged out of the coolant cavity.

3. Convex edges are provided inside the base and form a flow path for the coolant to pass through. Meanwhile, the first liquid outlet hole is arranged at a position abutting against the second side plate. As such, the coolant entering the flow path formed by the convex edge can only flow through the flow path into the first gap before being discharged. In this way, the duration for discharging of the coolant may be prolonged, which results in a more sufficient cooling. Meanwhile, the plate surfaces of the graphite sleeve may be uniformly cooled in the width direction.

4. The first gap and the second gap are disposed at two ends of the coolant cavity along the length directions of the drawing holes. By providing a liquid guide plate and a liquid guide groove, the coolant may enter the coolant cavity from above the second gap, causing the coolant to flow through the entire flow path before being discharged, which further guarantees the cooling effect and offers a more uniform and thorough cooling.

5. By providing a plurality of liquid guide plates, wherein each liquid guide plate corresponds to the liquid guide groove and the first liquid inlet hole, the whole cooling jacket enables simultaneous and multiple accesses of the coolant, which avoids a situation that when there is only one first liquid inlet hole. If the graphite sleeve and the cooling jacket have a relatively large width value, the coolant entering the coolant cavity can only cool the nearby of the first liquid inlet but cannot cool a further distance. With this arrangement, the graphite sleeve can be uniformly cooled in both lateral and longitudinal directions, thereby guaranteeing the production quality.

6. Whether to set one graphite sleeve or set multiple graphite sleeves may be flexibly determined based on the production demands. When one graphite sleeve is set, it is only required to attach the first cooling jacket to two sides of the plate surfaces of the graphite sleeve; when it is needed to increase the output, more graphite sleeves may be arranged. By providing a second cooling jacket between adjacent graphite sleeves and attaching the first cooling jacket to the outer side face of the graphite sleeve at the outermost side, not only the production process requirements can be satisfied, the number of copper bars that may be drawn out may also increase.

7. When being disposed at different positions, the structures of the first and second cooling jackets will also vary. To adapt their positions between two adjacent graphite sleeves, the second cooling jacket may be correspondingly adjusted to arrange the second liquid inlet hole and the second liquid outlet hole at a same side; meanwhile, a plurality of coolant passages is provided inside the coolant cavity. In this way, it may be guaranteed that the adjusted second cooling jacket can still satisfy cooling demands of the graphite sleeves.

8. By attaching cooling jackets to both side faces of the graphite plate, a thorough cooling of the graphite plate is guaranteed.

These characteristics and advantages of the present disclosure will be disclosed in detail in the preferred embodiments below with reference to the accompanying drawings. The best modes or means of carrying out the present disclosure will be illustrated in detail with reference to the accompanying drawings, but are not intended to limit the technical solution of the present disclosure. Additionally, each of the features, elements and components appearing in the following text and drawings is provided in plurality, and for the convenience of representation, they are labelled with different symbols or numbers; however, they all represent parts with same or similar structures or functions.

BRIEF DESCRIPTION OF THE DRAWINGS

Hereinafter, the present disclosure will be described in further detail with reference to the accompanying drawings.

In the drawings.

1—graphite sleeve, 11—drawing hole, 2—base, 21—convex edge, 22—partition, 23—first liquid outlet hole, 24—first gap, 25—second gap, 26—first side plate, 27—second side plate, 28—base plate, 3—cover plate, 31—first liquid inlet hole, 32—liquid guide groove, 4—liquid guide plate, 51—upper mount frame, 52—lateral mount frame, 63—lower mount frame, 6—second cooling jacket, 61—second liquid inlet hole, 62—second liquid outlet hole, 63—coolant passage, where the directions pointed by the arrows are flow directions of the coolant.

DETAILED DESCRIPTION OF EMBODIMENTS

Hereinafter, the technical solutions of the embodiments of the present disclosure will be explained and illustrated with reference to the accompanying drawings corresponding to the embodiments of the present disclosure. However, the embodiments are only preferred embodiments of the present disclosure, not all of them. Other embodiments obtained by those skilled in the art without exercise of inventive work based on the examples in the embodiments all fall within the protection scope of the present disclosure.

Herein, the recitations such as "one embodiment" or "an instance" or "an example" means that a specific feature, structure or property described with reference to the embodiment may be included in at least one embodiment of the present disclosure. The phrase "in an embodiment," when appearing at different positions herein, does not necessarily refer to a same embodiment.

In the description of the present disclosure, it needs to be understood that the oriental or positional relationships indicated by the terms "upper," "lower," "left," "right," "transverse," "longitudinal, "inner," and "outer," etc. are indications of oriental and positional relationships based on the drawings, which are intended only for easing description of the present disclosure, not for requiring that the present disclosure have to be configured and operated with those specific orientations; therefore, they should not be construed as limitations to the present disclosure.

Embodiment 1

Figure 1:
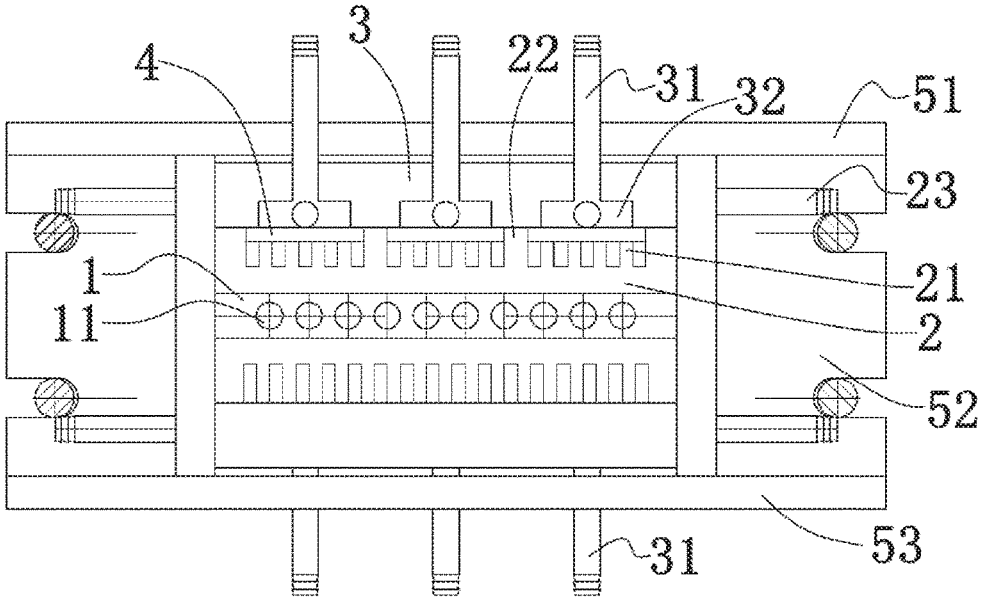
FIG. 1 is a cross-sectional view of Embodiment 1 of the present disclosure.
Figure 2:
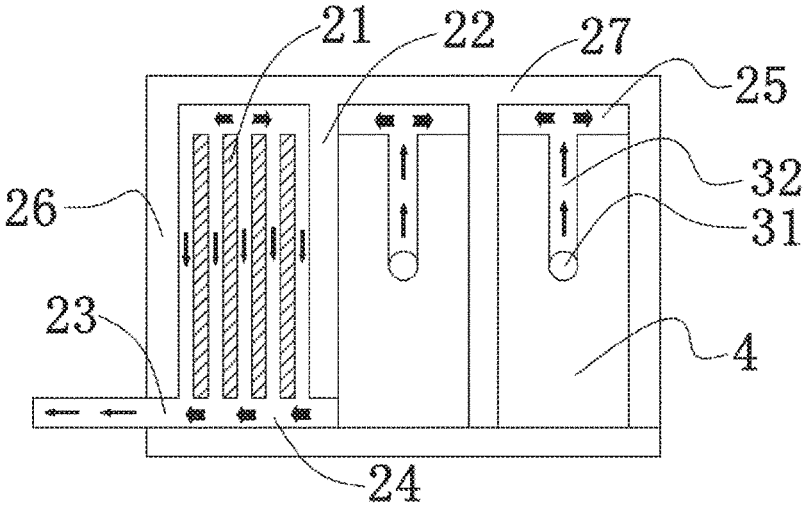
FIG. 2 is a schematic diagram of a coolant cavity in Embodiment 1 of the present disclosure.
Figure 3:
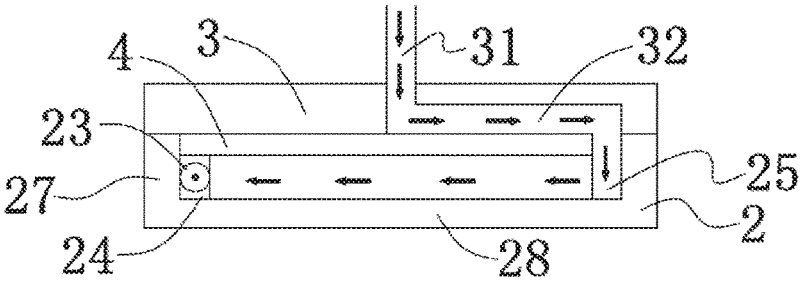
FIG. 3 is a flow diagram of coolant in Embodiment 1 of the present disclosure.

As shown in FIGS. 1-3, this embodiment provides a crystallizer for continuous casting, comprising a graphite sleeve 1 provided with a plurality of drawing holes 11, and a cooling jacket provided therein with a coolant cavity. In this embodiment, the coolant refers to cooling water. The graphite sleeve 1 is plate-shaped. In this embodiment, ten drawing holes 11 are arranged, such that 10 strands of copper bars may be drawn out. The ten drawing holes 11 are arranged in one row; the width of the graphite sleeve 1 and the number of drawing holes 11 may be set based on the number of copper bars that need to be drawn out, such that number of copper bars being drawn out can be more. The drawing holes 11 penetrate through the graphite sleeve 1 along a length direction of the graphite sleeve 1. In this embodiment, one graphite sleeve 1 is provided, and two sides of the plate surfaces of the graphite sleeve 1 are both attached to a first cooling jacket to cool the graphite sleeve 1, which guarantees the cooling effect of the first cooling jacket.

The first cooling jacket comprises a cover plate 3 and a base 2, wherein the base 2 comprises a base plate 28, a first side plate 26 parallel to a length direction of the drawing hole 11, and a second side plate 27 perpendicular to the length direction of the drawing hole 11, wherein the cover plate 3, the base plate 28, the first side plate 26, and the second side plate 27 enclose a cooling water cavity. When the length of the graphite sleeve 1 is greater than that of the first cooling jacket, the first cooling jacket may be extended by connecting a plurality of first cooling jackets. Moreover, different lengths of first cooling jackets may be fabricated for connecting with each other to satisfy cooling demands of graphite sleeves 1 of different lengths; as such, the adaptability of the first cooling jacket may be enhanced. Further, if the graphite sleeve 1 has a relatively large length value, use of the first cooling jacket of an equal size might cause a phenomenon of ununiform cooling; while the approach of connecting a plurality of first cooling jackets may avoid occurrence of such phenomenon and thus guarantees production quality. The cover plate 3 is provided with a first liquid inlet hole 31, such that the inlet liquid uniformly enters the coolant cavity; the base plate 28 is provided with a plurality of bar-shaped convex edges 21; length directions of the convex edges 21 are parallel to the first side plate 26; two adjacent convex edges 21 form a flow path for the cooling water to pass through, such that the cooling water can only flow through the flow path into the first gap 24 before being discharged; in this way, the duration of discharging the coolant may be prolonged, resulting in a more sufficient cooling; meanwhile, the plate surfaces of the graphite sleeve 1 may be uniformly cooled in the width direction. Gaps are provided between two end faces of the convex edges 21 and the second side plate 27, forming the first gap 24 and the second gap 25; the first liquid outlet hole 23 is disposed at the first side plate 26, and the first liquid outlet hole 23 is also provided on the two first side plates 26 at two sides, such that the coolant that has finished cooling may be autonomously discharged out of the coolant cavity. The first liquid outlet hole 23 is arranged at the first gap 24. The first cooling jacket comprises a liquid guide plate 4, the liquid guide plate 4 being provided between the convex edges 21 and the cover plate 3 and abutting against the convex edges 21; an inner side face of the cover plate 3 is provided with a liquid guide groove 32 in communication with the first liquid inlet hole 31; the liquid guide groove 32 and the liquid guide plate 4 guide the cooling water above the second gap 25 and then into the cooling water cavity; by arranging the liquid guide plate 4 and the liquid guide groove 32, the coolant may enter the coolant cavity from above the second gap 25, forcing the coolant to flow through the entire flow path before being discharged, which further guarantees the cooling effect and makes the cooling more uniformly and thoroughly.

In this embodiment, three liquid guide plates 4 are provided. The three liquid guide plates 4 are arranged abreast along a direction which the drawing holes 11 are arranged; a partition 22 is provided between adjacent liquid guide plates 4, wherein the partition 22 is formed by raising the convex edges 21. One side of the partition 22 proximal to the second gap 25 is connected to the second side plate 27; the second gap 25 is partitioned into three segments, while the other side of the partition 22 is not connected with the second side plate 27; the three segments of first gap s 24 corresponding to the three segments of second gap s 25 are maintained unblocked to facilitate the cooling water to pass through. The number of the liquid guide grooves 32 and the number of first liquid inlet holes 31 correspond to the number of liquid guide plates 4, such that the whole first cooling jacket enables simultaneous and multiple accesses of the coolant, which avoids a situation that when there is only one first liquid inlet hole 31, if the graphite sleeve 1 and the first cooling jacket have a relatively large width value, the coolant entering the coolant cavity can only cool the nearby of the first liquid inlet hole 31 but cannot cool a further distance. With this arrangement, the graphite sleeve 1 can be uniformly cooled in both lateral and longitudinal directions, thereby guaranteeing the production quality.

The graphite sleeve 1 has two side faces along the length directions of the drawing holes 11; the cooling jacket comprises a third cooling jacket (not shown), and the two side faces are both attached to the third cooling jacket to cool the side faces of the graphite sleeve 1.

In this embodiment, the base 2, and the first side plate 26, the second side plate 27, the base plate 28, the convex edge 21, and the partition 22, which are provided on the base 2, are all made of copper or other heat conductive materials, while the cover plate 3 and the liquid guide plate 4 are made of iron.

The graphite sleeve 1 and the first cooling jacket attached to two sides of the plate surfaces of the graphite sleeve 1 are mounted in a mount frame, wherein the mount frame comprises an upper mount frame 51, two side mount frames 52, and a lower mount frame 53; and both of the first liquid inlet hole 31 and the first liquid outlet hole 23 are connected to an external cooling water system via pipelines.

In this embodiment, when in use, the copper liquid is drawn out from the drawing holes 11 on the graphite sleeve 1 by a drawing head (drawing rod), and in the drawing holes 11 of the graphite sleeve 1, the copper liquid is solidified into a copper bar when being cooled by the cooling jacket, wherein the copper bar is continuously drawn out. In this way, for copper bars with a diameter under Φ50 mm, each set of crystallizer may draw out more than 5 strands per time, or even implement horizontal continuous casting of dozens of strands of copper and copper alloy bars.

As shown in FIG. 3, the cooling water enters from the first liquid inlet hole 31; the liquid guide groove 32 provided at the inner side of the cover plate 3 forces the cooling water to only flow along a direction inverse to the first liquid outlet hole 23 and enter the coolant cavity from above the second gap 25. Meanwhile, due to the partitioning function of the partition 22 with respect to the second gap 25, the cooling water entering from one first liquid inlet hole 31 can only enter, in the corresponding segment of the second gap 25, the flow path formed by the convex edges 21. The cooling water flows to the first gap 24 along the flow path. Because the partition 22 does not partition the first gap 24, the cooling water in the three segments of first gap 24 converge there and is discharged through the first liquid outlet holes 23 at two sides.

Embodiment 2

Figure 4:
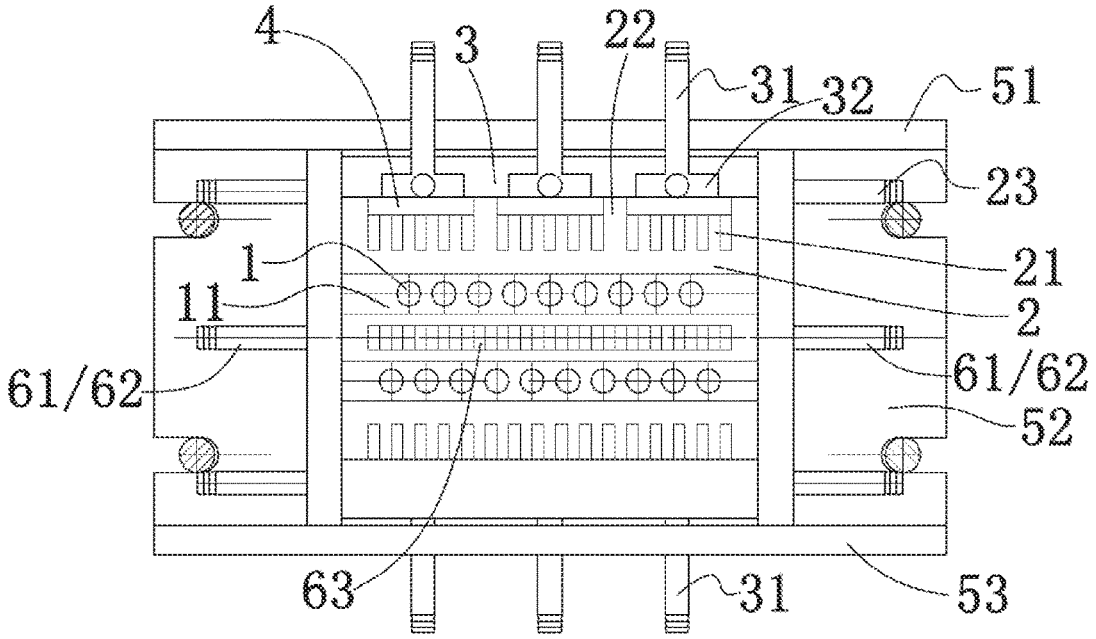
FIG. 4 is a cross-sectional view of Embodiment 2 of the present disclosure.
Figure 5:
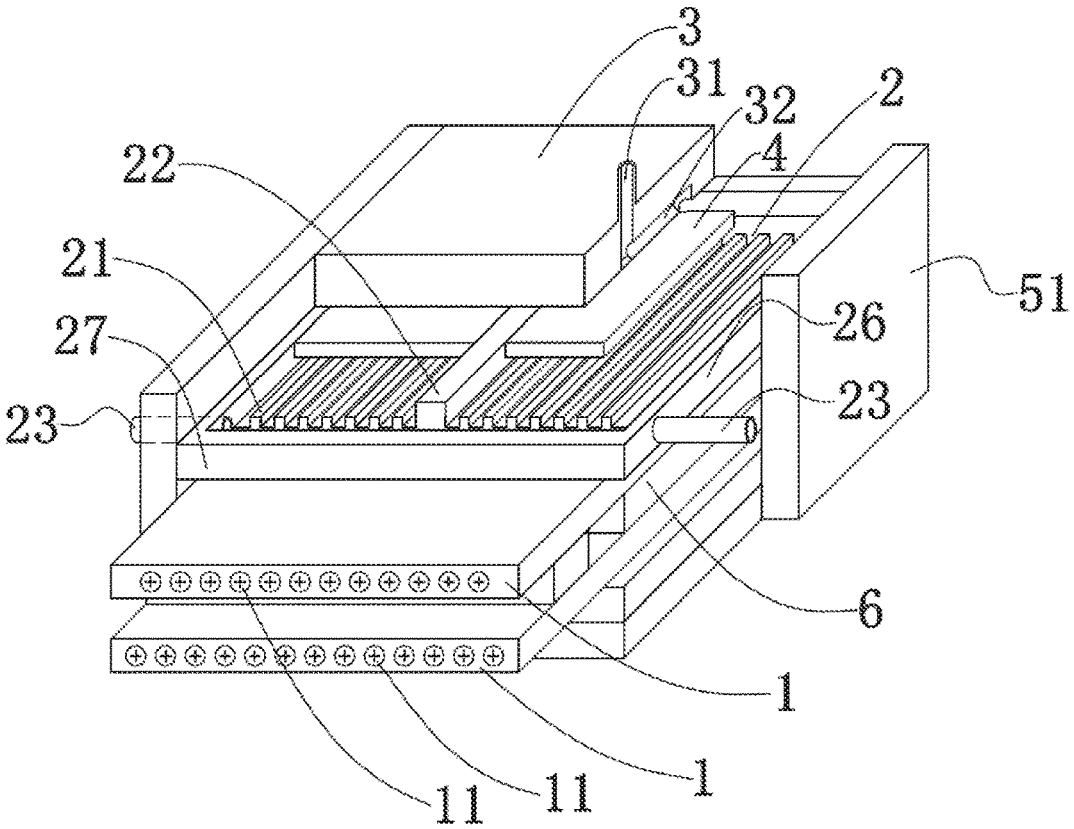
FIG. 5 is a stereoscopic view of Embodiment 2 of the present disclosure.

As shown in FIGS. 4 and 5, this embodiment provides a crystallizer for continuous casting.

Different from Embodiment 1, in the current embodiment, the crystallizer for continuous casting further comprises a second cooling jacket 6; two graphite sleeves 1 are provided; the second cooling jacket 6 is attached between two adjacent graphite sleeves 1; two first cooling jackets are provided, wherein the two graphite sleeves 1 and the one second cooling jacket 6 are disposed between the two first cooling jackets. Whether to arrange two graphite sleeves 1 or more graphite sleeves 1 may be flexibly determined based on production demands.

The second cooling jacket 6 comprises a second liquid inlet hole 61 and a second liquid outlet hole 62; the second liquid inlet hole 61 and the second liquid outlet hole 62 are disposed at a same side along the length direction of the drawing holes 11. In this embodiment, both sides along the length direction of the drawing holes 11 are provided with the second liquid inlet hole 61 and the second liquid outlet hole 62, and a plurality of cooling water passages 63 are provided inside the cooling water cavity of the second cooling jacket 6. When there is a need to increase the output, the second cooling jacket 6 is provided between the adjacent graphite sleeves 1, and the first cooling jacket is attached to the outer side surface of the graphite sleeve 1 at the outermost side, which not only satisfies production process needs, but also may increase the number of copper bars that can be drawn out. To adapt their positions between two adjacent graphite sleeves, the second cooling jacket 6 may be corresponding adjusted to dispose the second liquid inlet hole 61 and the second liquid outlet hole 62 at a same side; meanwhile, a plurality of coolant passages 63 is provided inside the coolant cavity. In this way, it may be guaranteed that the adjusted second cooling jacket can still satisfy the cooling demand of graphite sleeves.

What have been described above are only preferred embodiments of the present disclosure; however, the protection scope of the present disclosure is not limited thereto. A person skilled in the art should understand that the present disclosure includes, but not limited to the contents described in the drawings and the preferred embodiments. Any modifications without departing from the functions and structural principles of the present disclosure will be included within the scope of the claims.

What is claimed is:

1. A crystallizer for continuous casting, comprising:

a graphite sleeve provided with a plurality of drawing holes, and at least two cooling jackets provided inside with a coolant cavity, wherein the graphite sleeve is plate-shaped and has two plate surfaces;

the drawing holes penetrate through the graphite sleeve along a length direction or a width direction of the graphite sleeve; and the at least two cooling jackets are plate-shaped, and the two plate surfaces are both attached to the at least two cooling jackets to cool the graphite sleeve, wherein the at least two cooling jackets comprise two first cooling jackets, each of the two first cooling jackets including a cover plate and a base; the base comprises a base plate, a first side plate parallel to a length direction of the drawing holes and a second side plate perpendicular to the length direction of the drawing holes; the cover plate, the base plate, the first side plate, and the second side plate enclose to form the coolant cavity; the cover plate is provided with a first liquid inlet hole; and the first side plate is provided with a first liquid outlet hole, wherein the base plate is provided with a plurality of bar-shaped convex edges, length directions of the convex edges being parallel to the first side plates, two adjacent convex edges form a flow path for a coolant to pass through; a first gap and a second gap are provided between two end faces of the convex edges and the second side plate, respectively, the first liquid outlet hole being disposed at the first gap, wherein each of the two first cooling jackets further comprises a liquid guide plate, the liquid guide plate being provided between the convex edges and the cover plate, an inner side face of the cover plate is provided with a liquid guide groove in communication with the first liquid inlet hole; the liquid guide groove and the liquid guide plate guide the coolant above the second gap into the coolant cavity, and wherein a plurality of liquid guide plates are provided, wherein the plurality of liquid guide plates is arranged abreast along a direction which the drawing holes are arranged; a partition is provided between adjacent liquid guide plates; the partition is disposed at one side of the second gap and connected with the second side plate; a number of the liquid guide grooves and a number of first liquid inlets correspond to a number of liquid guide plates.

2. The crystallizer for continuous casting according to claim 1, wherein one graphite sleeve is provided; and two sides of the plate surfaces of the graphite sleeve are both attached with each of the two first cooling jackets.

3. The crystallizer for continuous casting according to claim 1, wherein the at least two cooling jackets comprise the two first cooling jackets and at least one second cooling jacket, wherein two or more graphite sleeves are provided; the at least one second cooling jacket is attached between two adjacent graphite sleeves, the graphite sleeves and the second cooling jacket being provided between the two first cooling jackets.

4. The crystallizer for continuous casting according to claim 3, wherein the at least one second cooling jacket is provided with a second liquid inlet hole and a second liquid outlet hole, the second liquid inlet hole and the second liquid outlet hole being disposed at a same side of the length direction of the drawing holes.

5. The crystallizer for continuous casting according to claim 3, wherein a plurality of coolant passages is provided inside the coolant cavity of the at least one second cooling jacket.

6. The crystallizer for continuous casting according to claim 1, wherein the graphite sleeve has two side faces along the length directions of the drawing holes; the at least two cooling jackets comprises a third cooling jacket, and the two side faces are both attached to the third cooling jacket to cool the side faces of the graphite sleeve.

* * * * *